US011344060B2

(12) United States Patent
Zabaglo et al.

(10) Patent No.: US 11,344,060 B2
(45) Date of Patent: May 31, 2022

(54) CIGAR VENTILATION IMPLEMENT

(71) Applicant: Synge LLC, Alexandria, VA (US)

(72) Inventors: Todd Zabaglo, Alexandria, VA (US); Frank Meyers, Alexandria, VA (US); Mansoor Riaz, Alexandria, VA (US); David Reeb, Sykesville, MD (US)

(73) Assignee: SYNGE LLC, Alexandria, VA (US)

( * ) Notice: Subject to any disclaimer, the term of this patent is extended or adjusted under 35 U.S.C. 154(b) by 273 days.

(21) Appl. No.: 16/598,274

(22) Filed: Oct. 10, 2019

(65) Prior Publication Data

US 2020/0352227 A1 Nov. 12, 2020

Related U.S. Application Data

(63) Continuation-in-part of application No. 16/403,997, filed on May 6, 2019.

(51) Int. Cl.

| | |
|---|---|
| ***B26F 1/32*** | (2006.01) |
| ***A24F 13/24*** | (2006.01) |
| ***A24F 13/26*** | (2006.01) |

(52) U.S. Cl.

CPC ..... *A24F 13/26* (2013.01); *A24F 13/24* (2013.01); *B26F 1/32* (2013.01)

(58) Field of Classification Search

CPC ..... A24F 13/24; B26F 1/32
USPC ..... 131/254
See application file for complete search history.

(56) References Cited

U.S. PATENT DOCUMENTS

| | | | | |
|---|---|---|---|---|
| 308,906 | A * | 12/1884 | Larsen et al. | A24C 1/386 131/254 |
| 1,734,620 | A | 11/1929 | Gicopini | |
| 4,733,674 | A | 3/1988 | Sielck et al. | |
| 5,738,117 | A | 4/1998 | Fontaine, Jr. | |
| 5,836,318 | A | 11/1998 | Adams | |
| 5,852,808 | A | 12/1998 | Cherny | |
| 5,913,676 | A | 6/1999 | Kim | |
| 8,485,200 | B1 | 7/2013 | Levinger | |
| 2009/0133705 | A1 | 5/2009 | Smith | |
| 2009/0183743 | A1 | 7/2009 | Simmons et al. | |
| 2011/0146696 | A1 | 6/2011 | Dipple | |

FOREIGN PATENT DOCUMENTS

| | | | | |
|---|---|---|---|---|
| DE | 29622111 U1 * | 3/1997 | ..... | B26F 1/32 |
| DE | 202018002142 U1 | 6/2018 | | |
| FR | 1028713 A * | 5/1953 | ..... | A24F 13/26 |
| KR | 1999-099403 | 3/1999 | | |

OTHER PUBLICATIONS

Machine Translation of FR 1028713 (Year: 1993).*
Machine Translation of DE 29622111 (Year: 1997).*

* cited by examiner

*Primary Examiner* — Kelly M Gambetta
*Assistant Examiner* — Russell E Sparks
(74) *Attorney, Agent, or Firm* — Bacon & Thomas, PLLC

(57) ABSTRACT

A cigar ventilating implement includes both a cylindrical punch and a piercing member such as a needle or spike. The punch and piercing member are sequentially extendable in response to a continuous twisting motion of a knob, with the sequencing being controlled by multiple slotted guide cylinders, a pair of actuator/driving cylinders, and a detent mechanism that initially prevents and subsequently enables relative rotation of the actuator and guide cylinders. Retraction of the punch and piercing members is carried out upon reverse rotation of the knob.

15 Claims, 12 Drawing Sheets

CIGAR VENTILATION IMPLEMENT

This application is a continuation-in-part of U.S. patent application Ser. No. 16/403,997, filed May 6, 2019, and incorporated herein by reference.

BACKGROUND OF THE INVENTION

1. Field of the Invention

The invention relates to a cigar ventilation implement, and in particular to a cigar ventilation implement that includes both (i) a punch for forming an opening in a binder or wrapper at an end of the cigar, and (ii) an elongated piercing member such as a needle or spike for additionally forming an axial passage having a selectable depth. The punch enables removal of the binder or wrapper from an area coextensive with the end of the cigar in order to prepare the cigar for smoking, while the elongated piercing member enables the smoker to modify the passage of smoke through the cigar according to the user's preference in order to enhance the smoking experience.

More particularly, the invention relates to a cigar ventilation implement with an extendable punch and an extendable elongated piercing member, stake, or needle. The punch and piercing member are sequentially rather than simultaneously extendable, in response to a continuous twisting motion of a knob, with the sequencing being controlled by multiple slotted guide cylinders, a pair of actuator/driving cylinders, and a detent mechanism that initially prevents and subsequently enables relative rotation of the actuator and guide cylinders. Retraction of the punch and piercing members is carried out upon reverse rotation of the knob.

2. Description of Related Art

Cigars are generally cylindrical rolls of tobacco characterized by cut, dried and fermented tobacco leaves encased in a binder and/or wrapper of relatively thicker leaves. Conventional cigars are typically formed with an open end, which is the end that is exposed to a flame in order to light the cigar, and a closed end. In order to prepare the cigar for smoking, the closed end must be cut, punched, or pierced to allow smoke-carrying air to be drawn from the lit open end through the main body of the cigar, the smoke-carrying air exiting the cigar into the smoker's mouth through the cut, punched or pierced end.

The most common method of ventilating a cigar in order to prepare it for smoking is to use a cutting implement, such as a guillotine-like cutter, to slice off the closed end of the cigar. However, slicing off the closed end can leave bits of loose tobacco that may end up in the smoker's mouth, and is a relatively wasteful way to achieve ventilation. In addition, cigar cutting implements are typically relatively large and require a degree of skill or dexterity to achieve an optimal cut that may be beyond that of the occasional smoker, the elderly, or disabled users. A bad cut cannot be reversed, and can ruin an expensive cigar.

Another known method of ventilating a cigar is to use a needle or spike to pierce the closed end of the cigar and form an axial passage. Such cigar-piercing spike or needle devices have a number of advantages over cigar cutters, including the relatively small size of the needle or spike, which allows it to fit on a keyring or otherwise to be easily carried, and the ability of the needle or spike to penetrate the cigar to a controllable depth, which can ameliorate the effects of a smaller diameter passage. In addition, use of a needle or spike to pierce the closed end of the cigar is less wasteful than cutting, and solves the problem of loose tobacco leaves. However, this alternative has the disadvantage, for true cigar aficionados, that the relatively small diameter of the passage for smoke prevents smoke from passing through the full cross-section of the cigar, which can result in a duller flavor and a less satisfying experience. The best cigars have specially selected leaves that differ along the length and/or diameter of the cigar, and cannot be fully experienced if the passage of smoke is limited to the diameter of a needle or spike.

Yet another known method of ventilating a cigar is to use a cylindrical cigar punch to removes a circular piece of the end wrapper and provide a relatively large diameter opening in the cigar end, thereby permitting a relatively large volume of smoke to pass through the entire cross-section of the cigar, while at the same time presenting. Unlike a cutter or piercing device, however, the cylindrical punch does not provide a way for the user to control the depth of the opening and thereby customize the smoking experience by controlling the passage of smoke through the cigar.

To overcome the above-described shortcomings of conventional cigar ventilating implements, inventors of the improved cigar ventilation implement described herein have devised a way to combine a punch and a needle or spike-type piercing tool, in a single implement that does not require enhanced skills or dexterity to manipulate and that can easily be carried by the user. The improved cigar ventilation implement thus has advantages of both the punch and the piercing tool, including the formation of a relatively large-diameter opening to enable the full cross-section of the cigar to be enjoyed, and the provision of an axial passage having a controllable depth. Furthermore, the invention has additional advantages of providing for retraction into the device of both the punch and piercing implement to ensure safety, as well as an especially simple and easy-to-assemble construction in comparison with conventional cutters.

One embodiment of the improved cigar ventilation implement with retractable punch and piercing member is described in copending parent application Ser. No. 16/403,997. The embodiment described in the patent application utilizes linear movement, a spring bias, and just four main parts to achieve sequential extension and retraction of the punch and piercing member. The embodiment disclosed in the present application eliminate the spring and utilizes rotating cylinders, guide slots, and a detent mechanism to achieve sequential extension and retraction of the punch and piercing member.

By way of background, U.S. Pat. No. 4,733,674 shows an example of a prior art plunger-actuated needle or spike-type cigar-piercing ventilating implement that includes a flange for providing leverage when operating the plunger in a manner similar to a medical syringe. The plunger-actuated ventilating implement operates in a manner similar to that of the invention, but without an additional extendable punch. Other examples of cigar piercing devices that utilize a needle or spike but that do not include an additional punch are found in U.S. Pat. Nos. 1,734,620 and 4,733,674, U.S. Patent Publication No. 2009/0183743, German Patent Publication No. DE 202018002142, and Korean Publication No. 1999-099403.

U.S. Pat. No. 5,852,808 is of interest because it includes both a fixed punch and a retractable needle. Because the punch is not extendable and retractable, the ventilating implement requires an additional screw-on cover to ensure that the cutting blade on the punch is not exposed when not in use. A similar arrangement of a piercing device with a cutting blade and a spike-like structure extendable into the cutting blade for pushing a cut plug out of the punch is disclosed in U.S. Patent Publication No. 2011/0146696.

On the other hand, U.S. Patent Publication No. 2009/0133705 discloses a cigar ventilator with fixed spike-like structure and a retractable cylindrical punch. However, the fixed spike-like structure at the center of the retractable cylindrical punch is used to eject the tobacco plug when the cylindrical punch is retracted, rather than serving as a retractable piercing device that is in addition to the retractable punch. U.S. Pat. No. 308,906, which issued in 1884, also shows a piercing device with a cutting blade and a punch that extends into the cutting blade for ejecting the cut plug.

Finally, by way of further background, U.S. Pat. No. 5,836,318 shows a cigar ventilating arrangement with a rotatable piecing device, U.S. Patent Publication No. 2010/0000553 discloses a cigar cutter with a rotatable piercing device that is combined with a pen, U.S. Pat. No. 925,158 discloses a combined cigar cutter and perforator, U.S. Pat. No. 8,485,200 discloses a combined cigar punch, flashlight, and keyring, and U.S. Pat. Nos. 5,738,117 and 5,913,676 are representative of numerous prior patents and publications that disclose a combined cigar cutter and lighter.

SUMMARY OF THE INVENTION

It is accordingly an objective of the invention to overcome the disadvantages of the prior art by providing a cigar ventilating implement that enables a user to prepare an end of the cigar for smoking by either piercing or punching the end of the cigar, or both, in a single unitary implement that does not require enhanced skills or dexterity to manipulate and that can easily be carried by the user so as to be available for use any time the user wishes to enjoy a cigar.

It is a further objective of the invention to provide a cigar ventilating implement that provides the user with the option of punch-cutting the end of a cigar, piercing it, or a combination of punching and piercing according to the user's preference, in order to optimize cigar preparation for different types of cigar, with minimal risk of A cutting error that might ruin the cigar.

It is also an objective of the invention to provide a cigar ventilating implement that meets at least one of the above objectives and yet that is relatively inexpensive to manufacture or assemble.

These objectives are achieved, in accordance with a first preferred embodiment of the invention, by a cigar ventilating implement that includes both a cylindrical punch and a piercing member such as a needle or spike, arranged coaxially and each extendable from an outer housing of the implement by gripping laterally extending flanges and pressing on an actuator in a manner similar to that used to operate a medical syringe. In a preferred embodiment of the invention, the cylindrical punch is extendable to a predetermined distance when pushing the actuator over a first section of its total range, after which the piercing member may be extended by a further distance upon pushing the actuator over a second section of its total range. A coil spring is provided to ensure retraction of at least the piercing implement back into the cylindrical punch when pressure on the actuator is released, while retraction of the cylindrical punch into the outer housing may be achieved by pulling up on the actuator or pushing up on the punch, to enable safe transport and storage of the implement.

The objectives of the invention may also be achieved by a cigar ventilating implement constructed in accordance with the principles of a second preferred embodiment of the invention, in which extension of first the punch and then the elongated member is achieved by a continuous twisting motion. In this embodiment of the invention, the punch extension and the piercing member extension are achieved by follower pins and respective slots in two coaxially arranged cylinders, and a detent mechanism that sequentially causes coupled and relative rotation of the two cylinders. While the number of parts is increased, the second preferred embodiment utilizes three slotted cylinders to convert the twisting motion of a knob into sequential extension of the punch and elongated piercing member eliminating the need for springs, and resulting in, simplified assembly, increased reliability, and smoother operation.

Although specific embodiments of the invention are described herein, those skilled in the art will appreciate that details of the construction may be varied by, for example, constructing individual parts as separate units, or adding separate additional parts such as bushings, washers, o-rings, and the like. Moreover, the illustrated stand-alone devices or implements, the cigar ventilating implement of the invention may be combined with a lighter or any other object or device, including by way of example and not limitation, a conventional cigar cutter, a pocket or utility knife, a key ring, and/or a flashlight. Accordingly, it is intended that the detailed description and drawings included herein should not be considered as limiting, with numerous variations or modifications of the illustrated embodiment being possible without departing from scope of the invention.

BRIEF DESCRIPTION OF THE DRAWINGS

FIGS. 2-4 FIGS. 1-3 are isometric views respectively showing a retracted state, a punch extension state, an a needle extension state of the cigar ventilation implement of FIG. 1.

DETAILED DESCRIPTION OF THE PREFERRED EMBODIMENTS

Throughout the following description and drawings, like reference numbers/characters refer to like elements. It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention.

Figure 1:
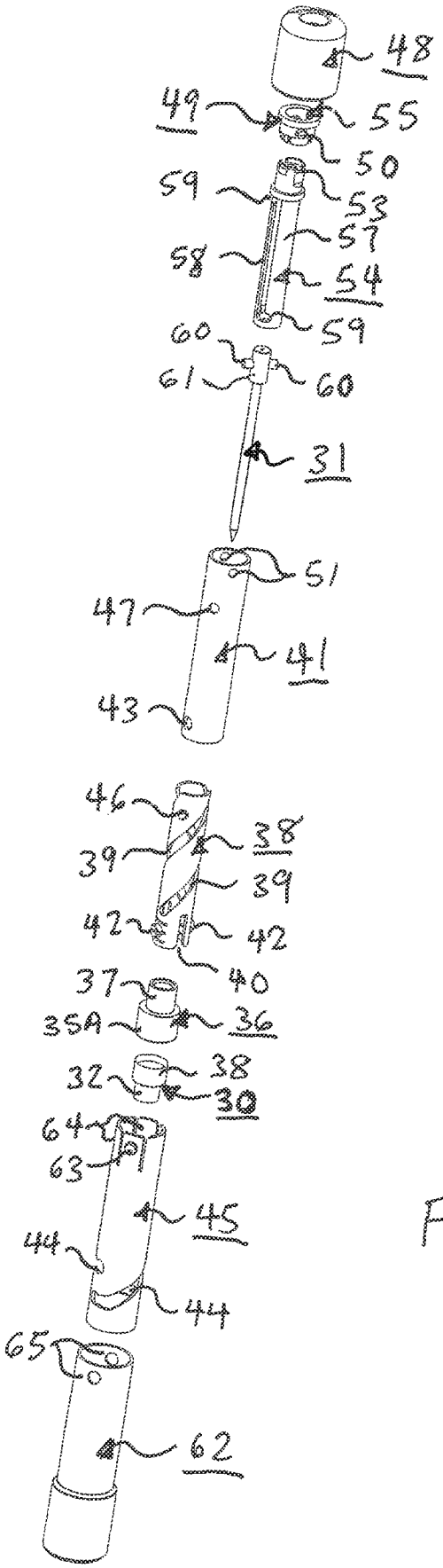
FIG. 1 is an exploded isometric view of a cigar ventilation implement constructed in accordance with the principles of a preferred embodiment of the invention.

As shown in FIG. 1, the cigar ventilation implement of a preferred embodiment of the invention includes ten discrete main parts. Details of the parts, their connections, and their operation will be provided below. The ten parts are: (1) a punch 30; (2) an elongated stake-like piercing member or needle 31 (hereinafter referred to an "needle 31"); (3) a knob 48; (4) a slotted guide cylinder 45 including a slot 44 for causing extension and retraction of the punch 30; (5) a punch driving cylinder 41 for causing the slotted guide cylinder 45 to rotate in response to twisting of the knob 48; (6) a slotted guide cylinder 38 including a helical guide slot 39 for causing extension and retraction of the needle 31; (7) a needle actuator cylinder 54 for causing follower pins 60 on a needle holder 60 to follow the helical guide slot 39 in order to extend and retract the needle 31 upon disengagement of a detent 53 on the actuator cylinder 54 from a corresponding one of recesses 52; (8) a connector 56 that includes recesses 52 for selectively coupling the actuator cylinder 54 and the punch driving cylinder 41 in order to cause the needle actuator cylinder 54 and punch driving cylinder 41 to initially rotate together to extend the punch, and to subsequently enable the needle actuator cylinder 54 to rotate relative to the punch driving cylinder 41 to extend the needle; (9) a punch holder 36 for fixing the punch 30 to the punch guide cylinder 38; and (10) an outer housing 62 fixed to the punch guide cylinder 45.

As shown in FIGS. 2-5, knob 48 fits over a rear end of the cylindrical outer housing 62, and is rotatable relative thereto in both clockwise and counterclockwise directions. Although outer housing 62 is illustrated as having a cylindrical main section 62' and an enlarged diameter front section 62", the exterior shape of the outer housing 62 is determined by aesthetic and/or ergonomic considerations and plays no role in the operation of the punch or needle extension mechanisms. As illustrated, the outer housing 62 has a unitary construction and may be cast or molded as a single piece, although multiple piece and/or multiple material constructions are also within the scope of the invention.

Figure 2:
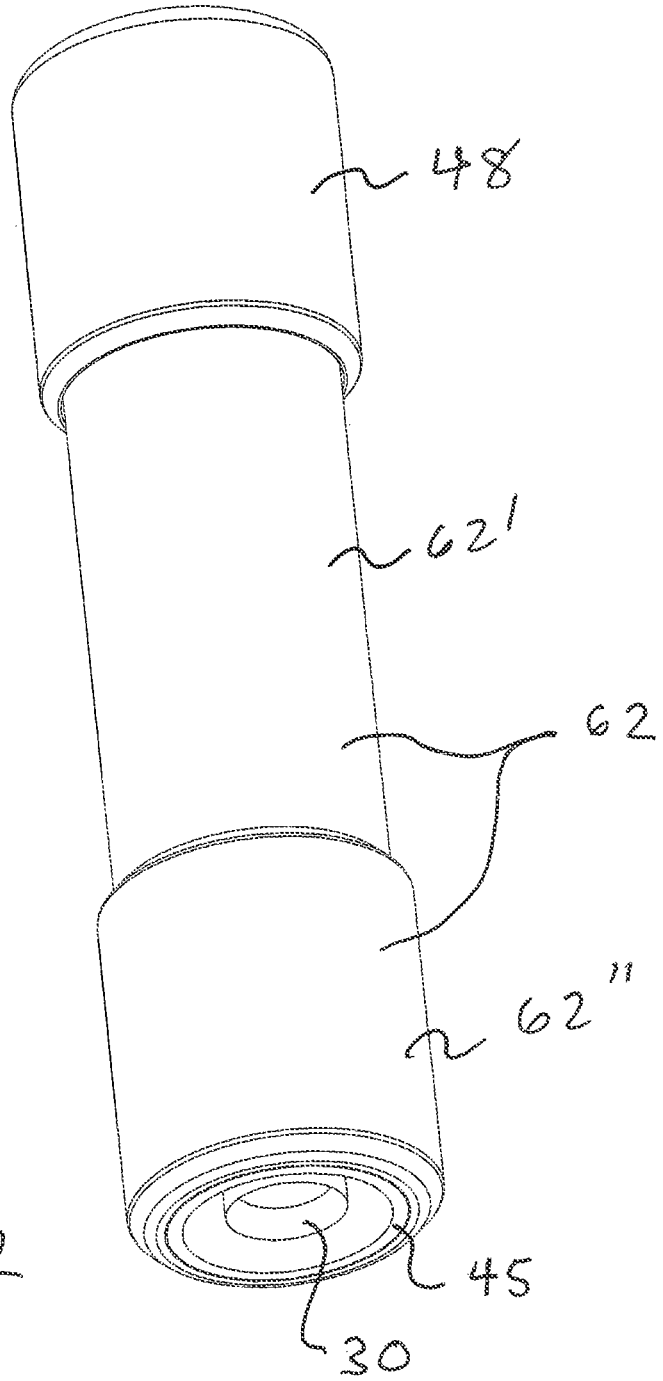

FIG. 2 shows an initial state in which the punch 30 and needle 31 are both retracted within the outer housing 62 for transport or storage. Only the punch 30 is visible in this view. The punch guide cylinder 45, which is fixed to the outer housing 62, is also visible.

Figure 3:
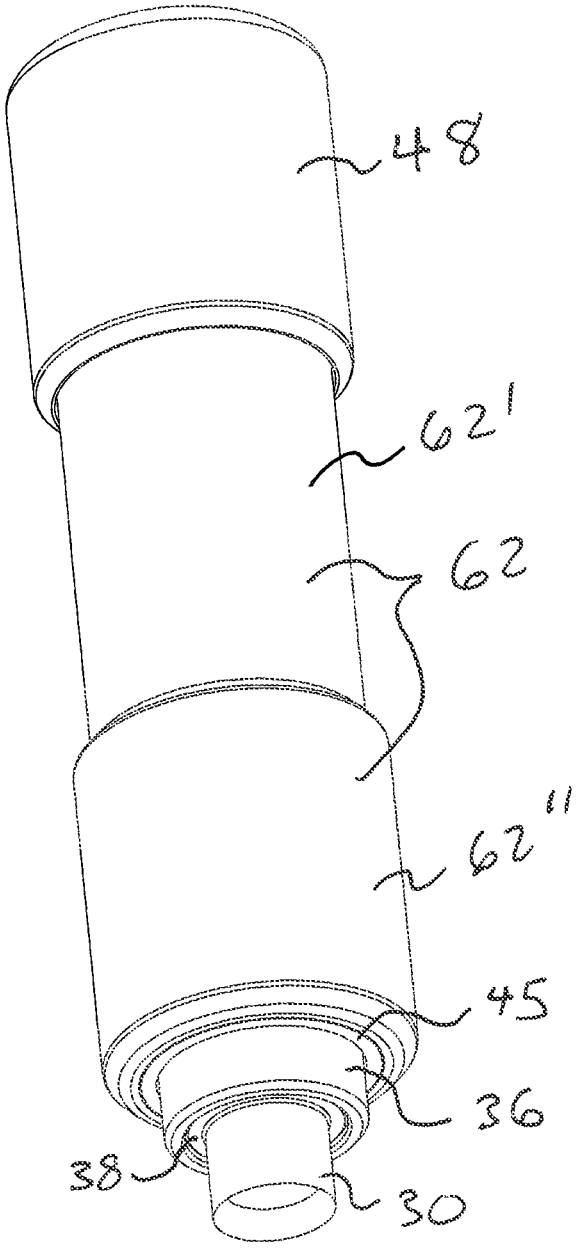
Figure 5:
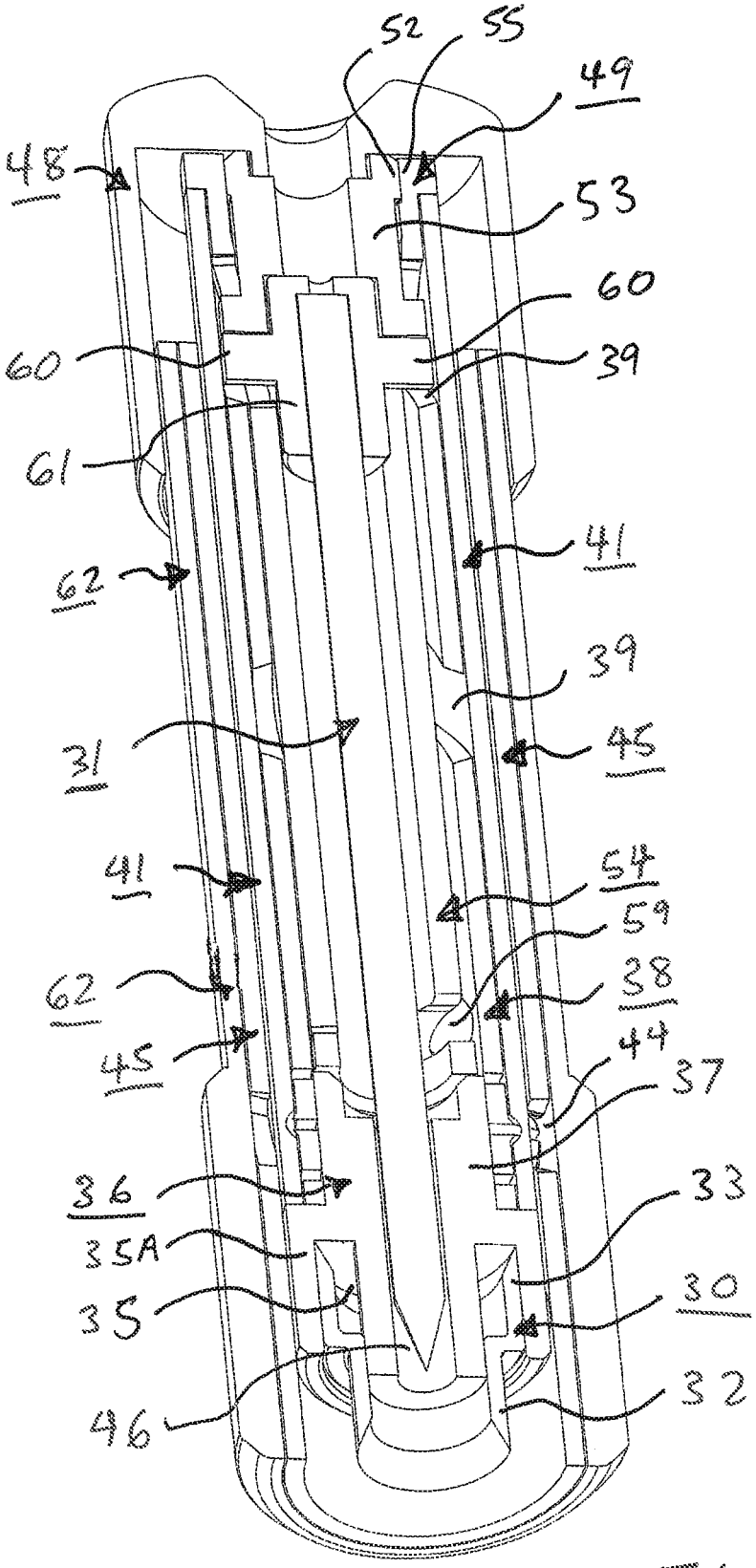
FIGS. 5-7 are cross-sectional side views of the cigar ventilation implement of FIG. 1, in the respective states illustrated in FIGS. 2-4.
Figure 6:
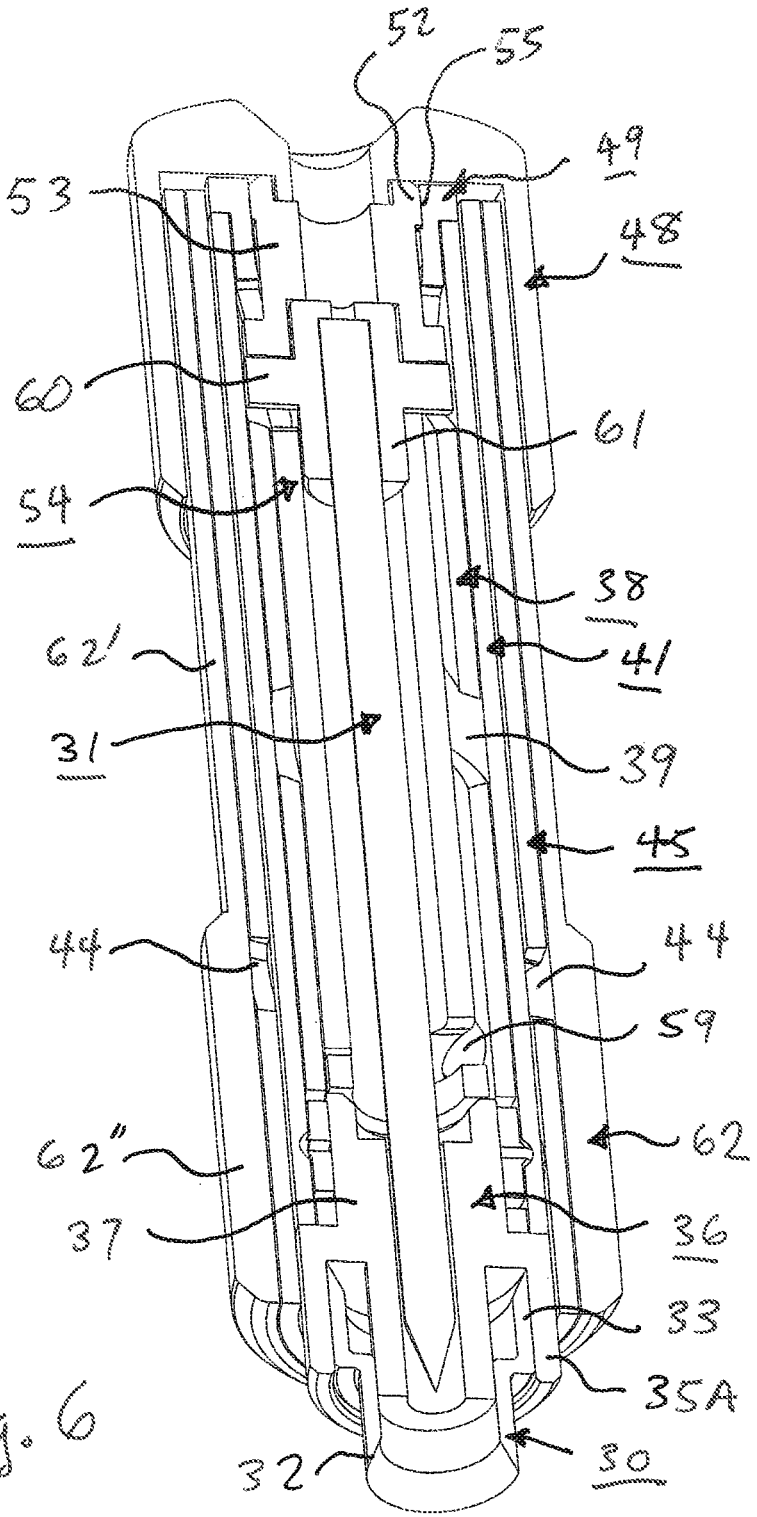
Figure 7:
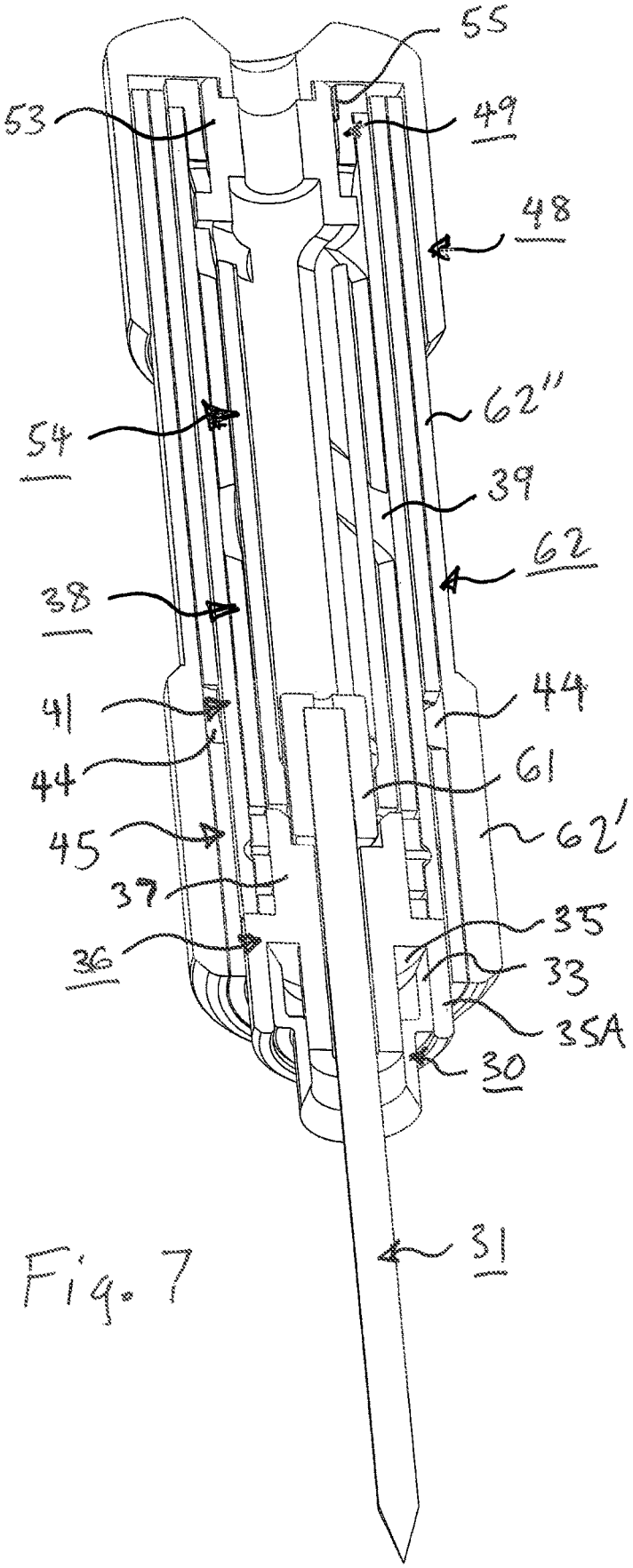

FIG. 3 shows the state in which the knob 48 has been manually rotated relative to the outer housing 62, causing punch 30 and punch holder 36 to extend from the outer housing 62. Also visible in this figure is the punch guide cylinder 45, which has rotated with the knob 48, and rear section of the punch 30, which fits into a groove 35 in the punch holder 36 (as shown in FIG. 5).

Figure 4:
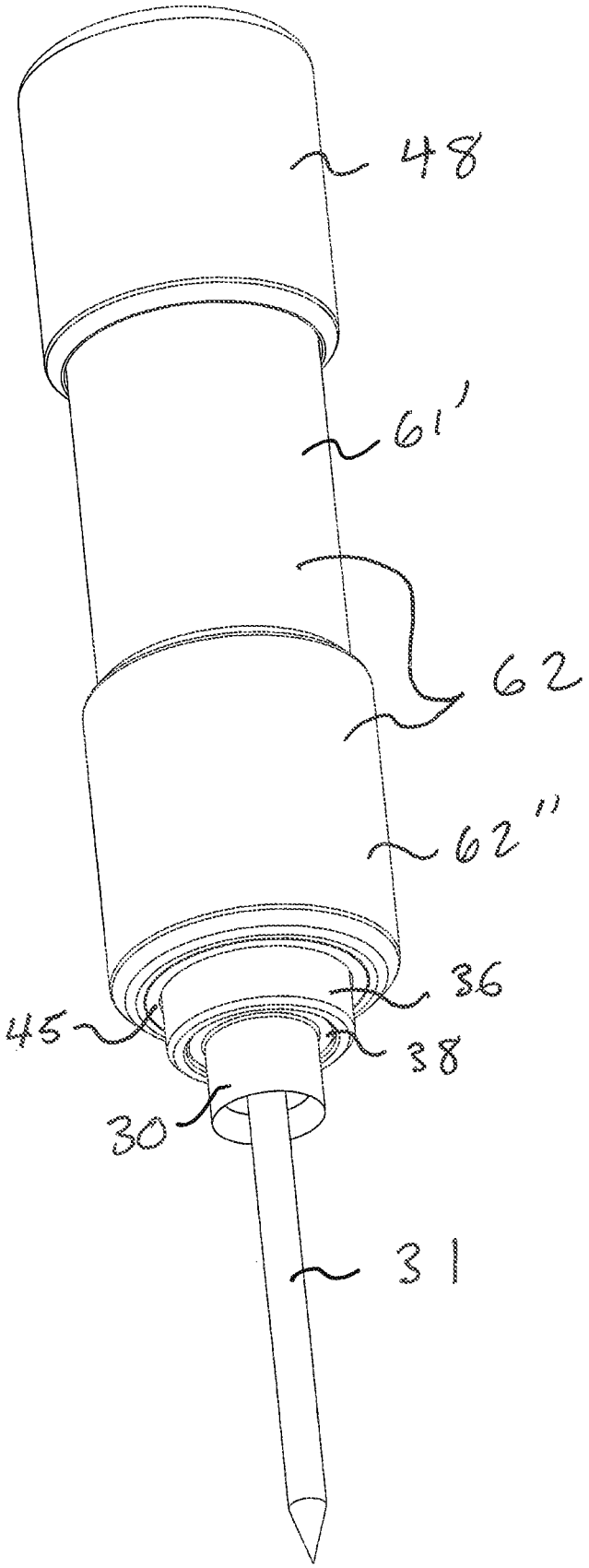

FIG. 4 shows the state in which the knob 48 has been further manually rotated relative to the outer housing 62 to cause needle 31 to extend from the outer housing 62 and the previously-extended punch 30. As will become apparent from the description below, the punch guide cylinder 45 shown in FIG. 4 is stationary during extension of the needle 31.

The detailed construction and operation of the punch and needle extension mechanisms will now be described in connection with FIGS. 5-12.

As best shown in FIGS. 1 and 5-7, punch 30 includes a cylindrical front section 32 having a wedge-shaped cutting tip 33 and an enlarged diameter rear section 34 that fits into and is held by a groove 35 in a front section 35A of punch holder 36. The fit between the rear section 34 of the punch 30 and the groove 35 of punch holder 36 may be an interference fit that enables the punch 30 to be removed from the holder, turned upside down, and replaced. According to this feature, the direction of the punch 36 in the holder is reversed, so that cylindrical front section 32 is now inserted into the groove and the enlarged diameter rear section 34, which also can include a cutting tip, faces outwardly to change the cutting diameter of the punch.

Figure 8:
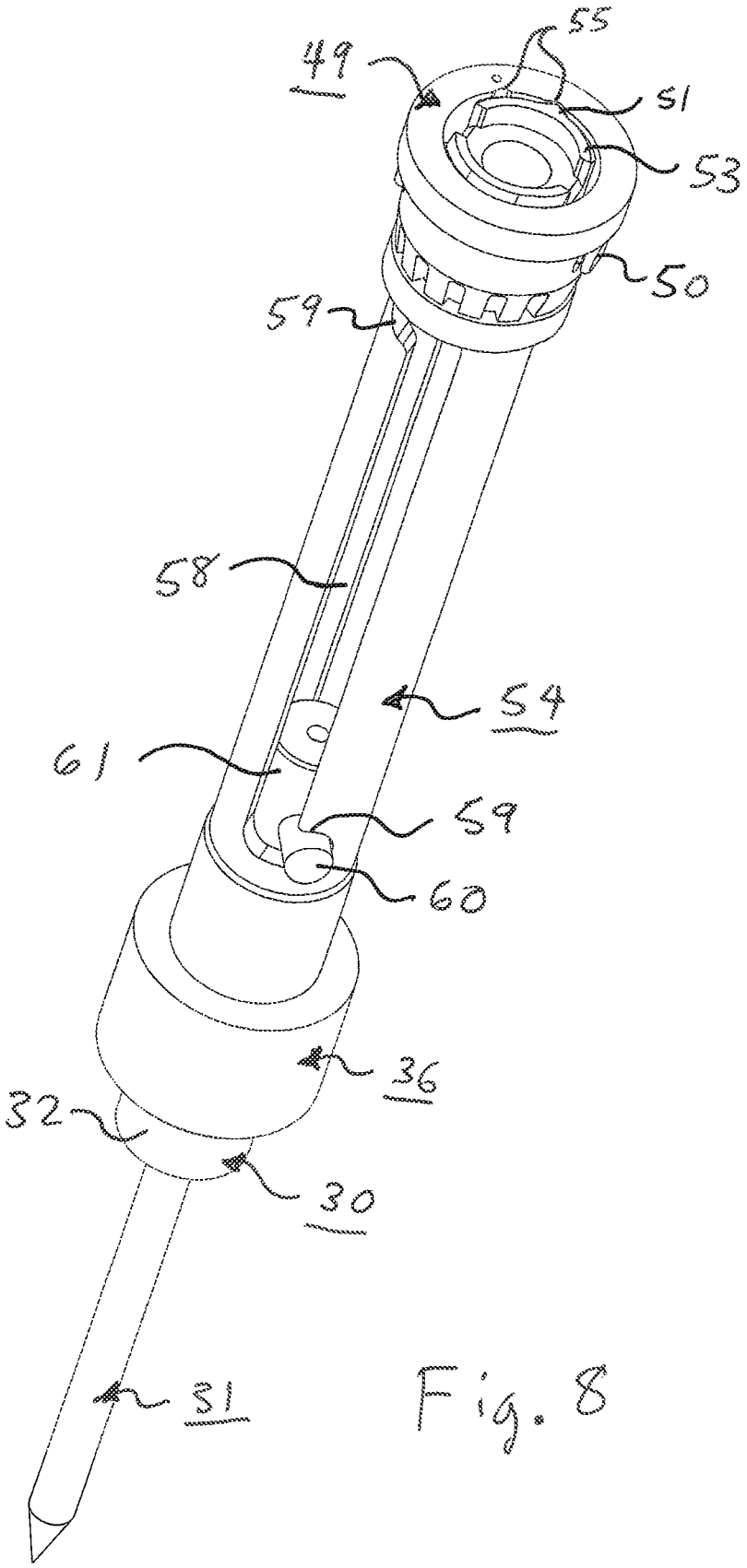
FIG. 8 is an isometric view of a subassembly that includes the needle actuator cylinder, punch, punch holder, and connector illustrated in FIGS. 1 and 5-7.
Figure 9:
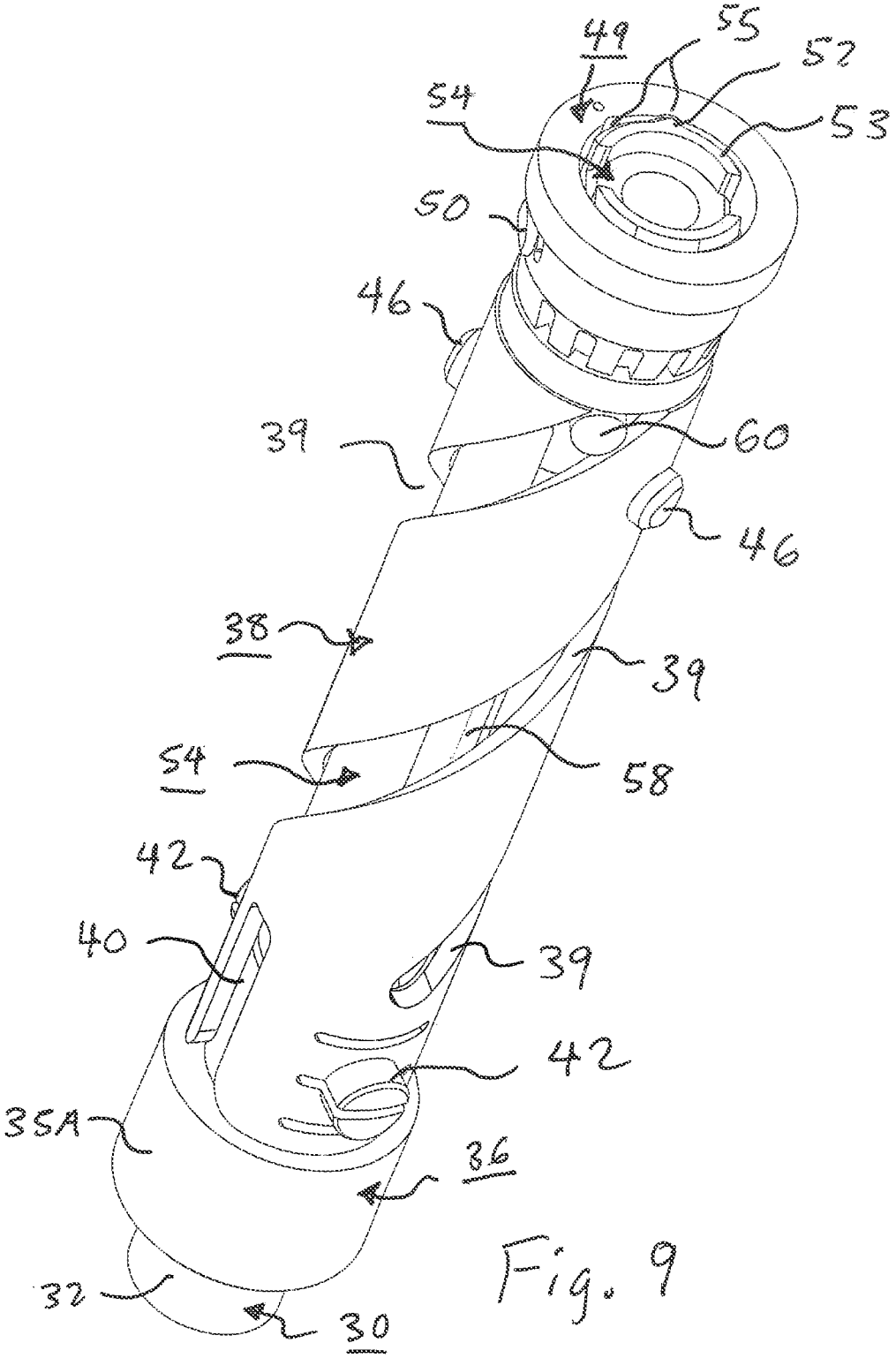
FIGS. 9 and 10 are isometric views of sub-assembly that includes a needle guide cylinder, into which has been inserted the sub-assembly of FIG. 8, before and after extension of the needle.
Figure 10:
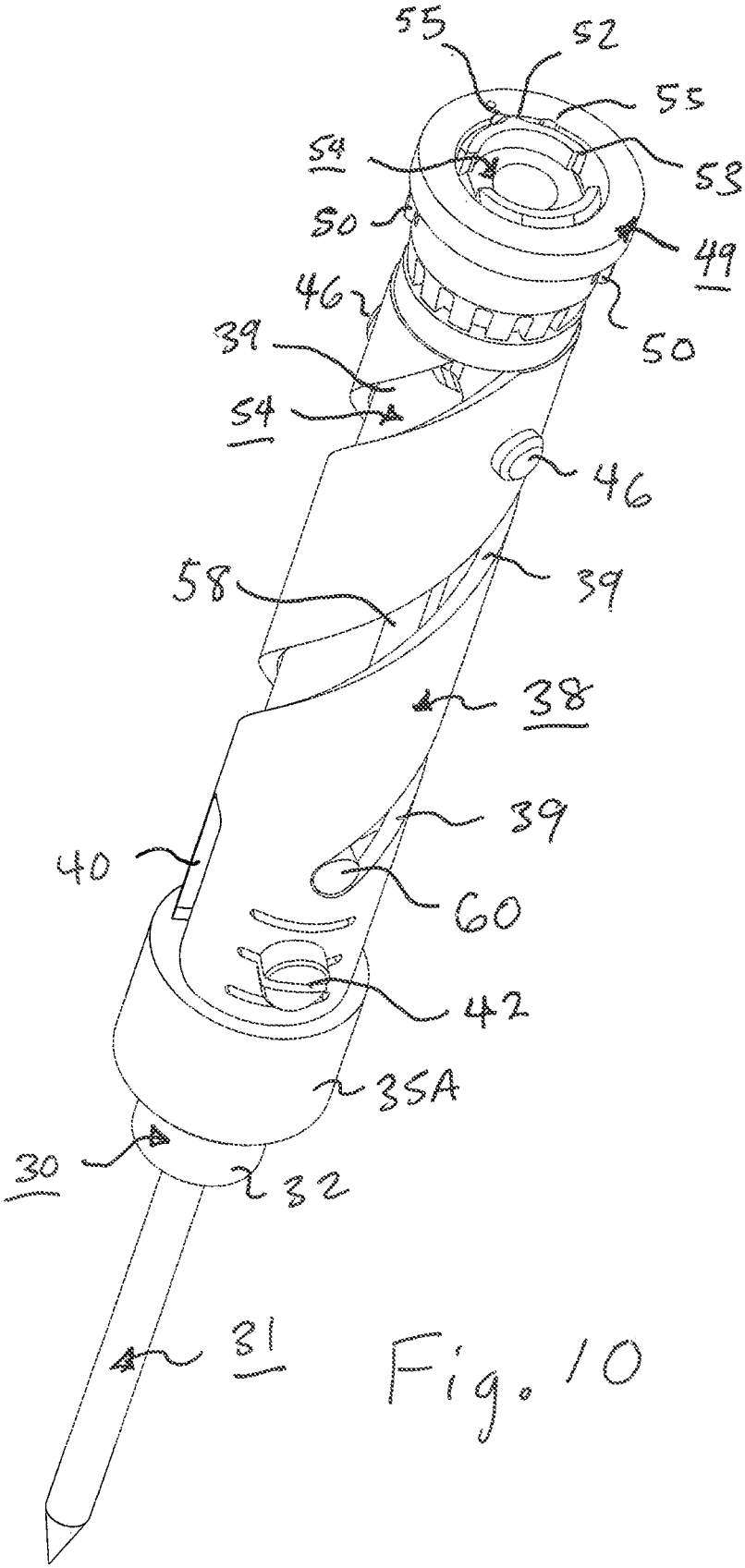

Punch holder 36 includes a reduced diameter rear section 37 that fits into a front end of a first slotted guide cylinder 38, which is also shown in FIGS. 9 and 10. First slotted guide cylinder 38 includes a helical slot 39 for guiding the needle 31 toward an extended position upon rotation of the first slotted actuating cylinder, and linear slots 40 to enable insertion of the first slotted guide cylinder 38 into a driving cylinder 41. Helical slot 39 receives needle extension follower pins 60 that extend radially outwardly from the needle holder 61 and pass through slots 38,39 in the needle actuator cylinder 54, as shown in FIG. 8.

Figure 11:
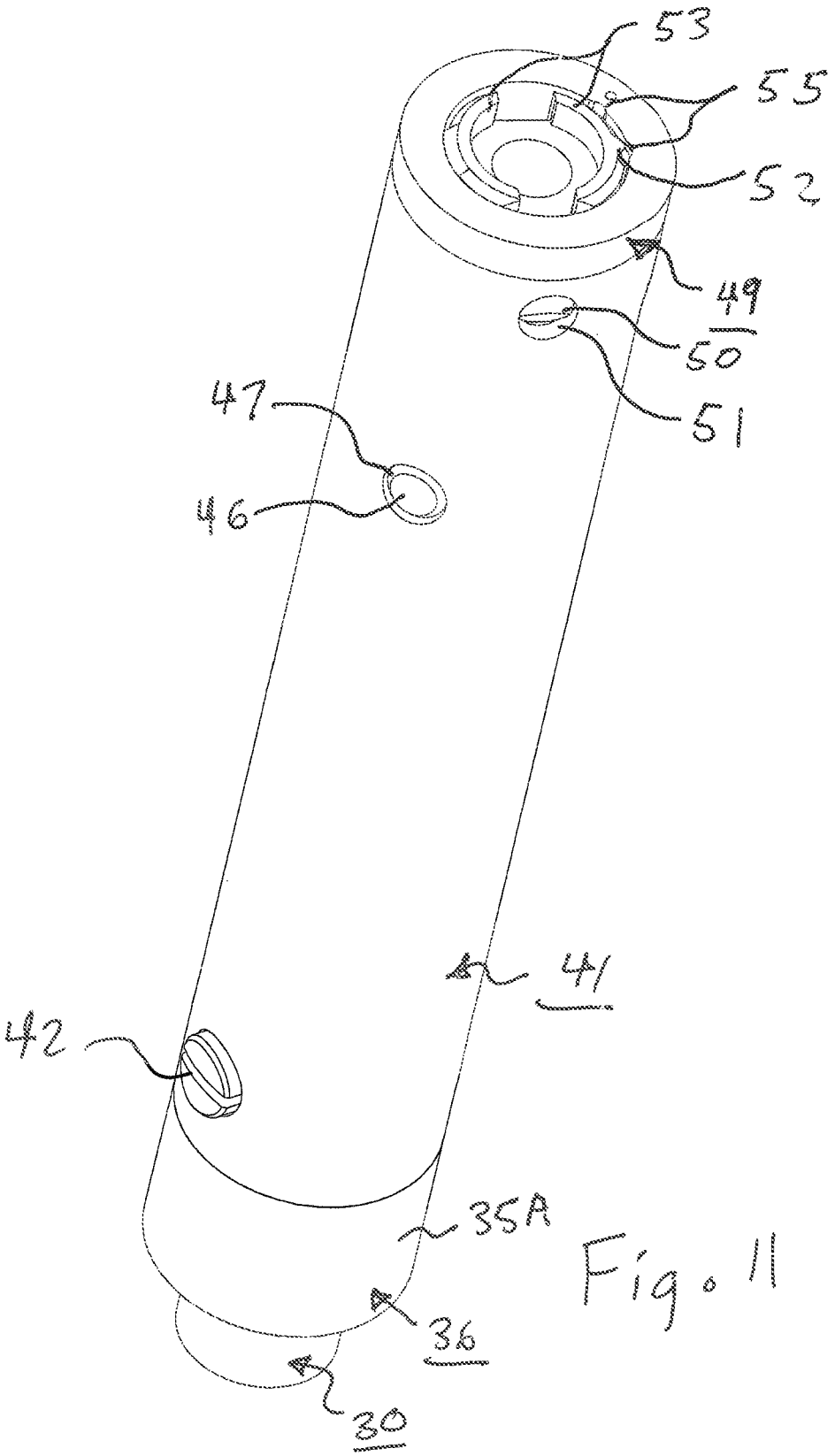
FIG. 11 is an isometric view of a punch extension driving cylinder, which has been fitted over the needle guide cylinder of FIGS. 9 and 10.
Figure 12:
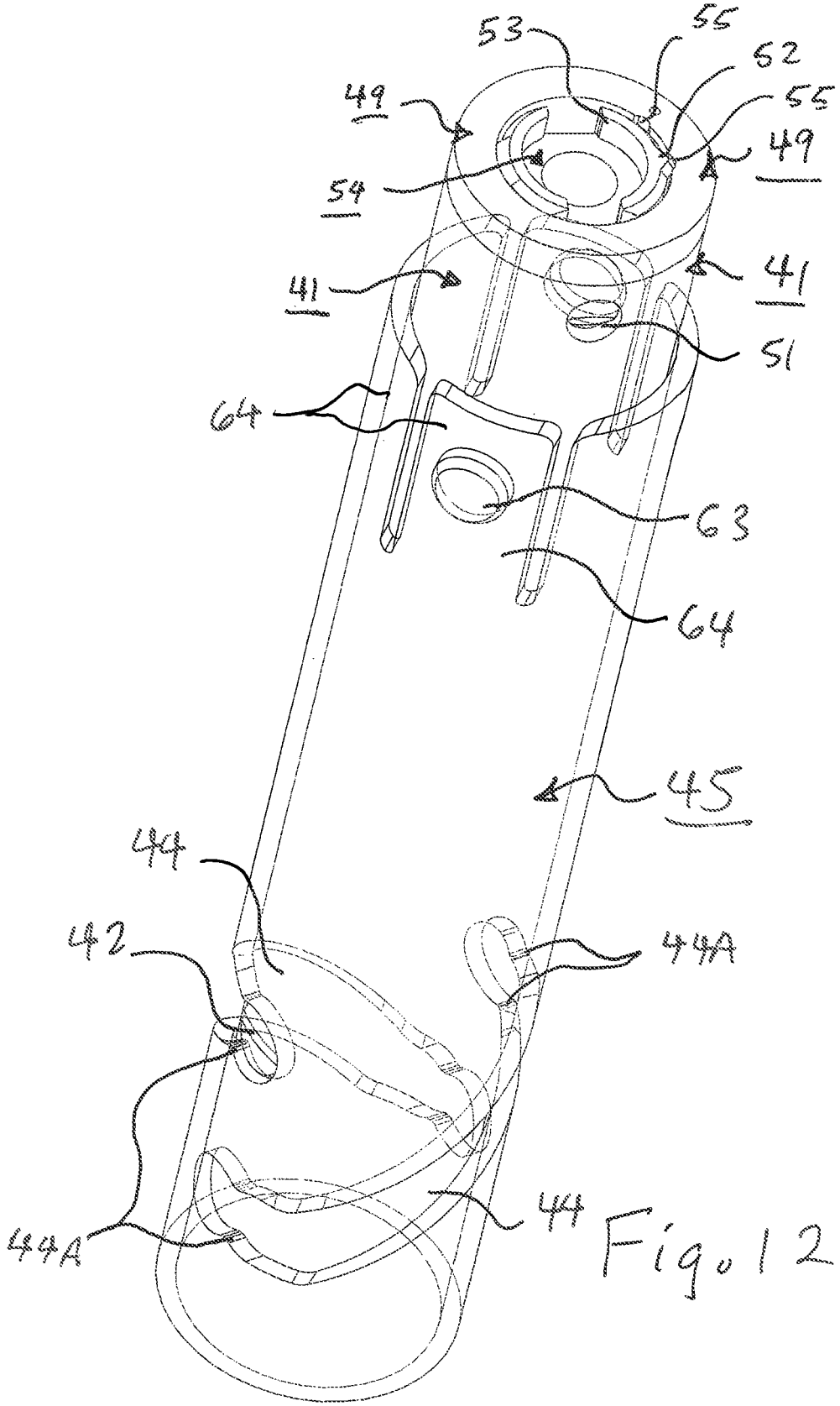
FIG. 12 is an isometric view of a punch extension guide cylinder, which has been fitted over the punch extension driving cylinder of FIG. 11.

The slotted guide cylinder 38 shown in FIGS. 9 and 10 further includes punch guide follower pins 42, which extend radially outwardly from a lower section of the slotted guide cylinder 38 and pass through holes 43 in driving cylinder 41 (as shown in FIG. 11) to be slidably received by punch extension slots 44 in the second slotted actuating cylinder 45, shown in FIG. 12 and described below. Slots 44 guide the movement of follower pins 42 as they are rotated by the driving cylinder to extend the punch 30. Optionally, the slots 44 may include detents 44A to hold the follower pins 42 against the ends of the slot 44 until the user of the implement applies a torque to the knob 48 in a disengagement direction. Punch holder 36 also includes a central bore 46 through which the needle 31 extends, and with respect to which the needle 31 is slidable in response to rotation of the first slotted guide cylinder 38, as described below.

The two punch extension follower pins 42 travel along the punch extension slots 44 as the first slotted guide cylinder 38 is rotated. Because the punch extension slots 44 are not only circumferential but also are angled or slope in an axial direction, movement of the punch extension follower pins in response to rotation of the driving member 41 (via the detent mechanism described below in connection with needle actuator 54 and connector 49) results in axial movement slotted guide cylinder 38 and the punch 30, so that the punch 30 is axially moved from the position shown in FIG. 5 to the position shown in FIG. 6. At this time, it is no longer possible to rotate the first slotted guide cylinder 38, because punch extension follower pins 42 have reached respective ends of the punch extension slots 44.

The detent mechanism that serves as a clutch or transmission between the needle actuator cylinder 54, the connector 49, and the punch extension driving cylinder 41 can best be understood in connection with FIGS. 8-11 The first slotted guide cylinder 38 is fixed to and rotatable with the driving cylinder 41 by the extension of follower pins 42 through the holes 43 and optionally by radially extending pins 46 and holes 47. Punch extension driving cylinder 41 is coupled to the need actuator cylinder by a detent mechanism that includes a detent 52 extending from a tine 53 at the top of the needle actuating cylinder 54, and recesses 55 in the connector 49, which is fixed with respect to the driving cylinder 41 by pins 50 radially outwardly extending from the connector 49 into driving pin holes 51 in the punch driving cylinder 41, as shown in FIG. 11.

The detent mechanism includes at least one detent 52 on the exterior of one of two tines 53 extending from needle actuator cylinder 54, and corresponding recess or channels 55 in the connector 49. Needle actuator cylinder 54 is fixed to and rotatable with the knob 48. So long as the needle actuator cylinder 54 and the driving cylinder 41 are both free to rotate, the coupling between detent 52 and one of the recess 53 transmits rotational motion of the needle actuator cylinder 54 to the driving cylinder 41, causing rotation of the driving cylinder 41 and the first slotted guide cylinder 38, so that the punch 30 extends downwardly relative to the second slotted actuating cylinder 45, until the punch extension follower pins 42 reach a lowest end of the punch extension slots 44, as described above.

When the punch extension follower pins 42 reach the ends of punch extension slots 44, driving cylinder 41 is prevented from further rotation. As a result, further turning of the knob 48 causes the detent 52 to exit the corresponding recess 53, allowing continued rotation of the knob 48 and actuator cylinder 54 relative to the driving cylinder 41, which causes follower pins 62 to travel along the helical slot 39 in response to rotation of the need actuator cylinder 54, so that the needle 31 is extended as the follower pins 60 travel along the helical slot 39. As the knob 48 continues be rotated to further extend the needle 31, the detent 52 will pass through additional recesses 53 for a clicking effect that does not prevent the relative rotation but that enables the needle extension to be stopped at a plurality of stable positions, in which the presence of the detent 52 in a respective one of the recesses 55 holds the needle 31 in the position to which it has been extended until the user applies further torque on the knob 48 to continue the extension motion.

Needle actuator cylinder 54 includes a cylindrical main body 57 with a pair of linear slots 58, each with perpendicular extensions 59 at ends of the slot. The edges of the slots 58 transmit a force to the follower pins 60 that causes the pins 60 to travel along the helical slot 39 in response to rotation of the needle actuator cylinder 54. As the follower pins 60 travel along the slot 39, the also move vertically relative to the linear slots 88 of the needle actuator cylinder 54 until the follower pins 60 reach the slot extensions 59. Further rotation causes the follower pins 60 to enter the extension slots 59 to positively prevent further vertical movement of the needle 31.

The cylindrical sleeve 61, from which the needle follower pins 60 extend radially outwardly, includes an internal bore 62 in which the needle 31 is received and secured, optionally by an adhesive. Needle actuator cylinder 54 is coaxially extends through the center of needle guide cylinder 38, such that the needle follower pins 60 can extend first through the linear slots 58 in the actuator cylinder 54, and then through the helical needle extension slots 39 in the needle guide cylinder 38, as described above.

Finally, to improve the appearance of the implement and enable the implement to be more easily gripped by a user, a cylindrical outer housing 62 is fitted over the slotted punch actuator cylinder 45, for example by attachment pins 63 extending from tines 64, which fit into holes 65 in the cylindrical outer housing 62.

In summary, the punch and needle extension operation of the cigar piercing implement is as follows: (I) First, upon initial rotation of the knob 48, punch extension driving cylinder 41 causes movement of punch extension follower pins 42 along the punch extension guide slots 44 of punch extension guide cylinder 45. As the follower pins 42 move along the slots, needle guide cylinder 38 (to which the follower pins are fixed) also rotates and in addition moves axially, resulting in extension of the punch 30, which is fixed to the needle guide cylinder 38. During this initial rotation, a needle actuator cylinder 54 is coupled to the rotating driving cylinder 41 (and the needle guide cylinder 38) via detent 51 and a respective one of recesses 55, causing the needle 31 to remain in a retracted position. (II) Second, when the follower pins 42 reach the lower ends of the slots 44, further rotation of the punch extension driving cylinder 41 with respect to the punch extension guide cylinder 45 is prevented, as a result of which further rotation of the knob 48 causes the detent 51 to exit respective recess 55, thereby decoupling needle actuator cylinder 54 to become decoupled from the punch extension driving cylinder 41 and needle guide cylinder 38. As a result, needle follower pins 60 are rotated by the needle actuator cylinder 54 relative to the needle guide cylinder 38, causing the follower pins 60 to move along a helical slot 39 in the needle guide cylinder 38, and thereby cause extension of the needle 31 from the lower end of the exemplary cigar ventilation implement.

It will be appreciated by those skilled in the art, based on the configurations of the punch extension slot 44 and the helical slot 39, that punch extension requires a rotation of knob 48 over an angle of less than 360° (approximately a half turn, for example), while subsequent extension of the needle 31 requires multiple rotations of the knob 48, for example two rotations (approximately 720°). These angles may be varied as desired by simply changing the lengths and slopes of the respective punch extension and helical needle extension slots.

Rotation of the knob 48 in a direction opposite to the punch extension and needle extension direction initially frees the punch extension follower pins 42 to move in an opposite direction in the punch extension guide slots 44, enabling retraction of the punch 30 as the punch actuating cylinder 41 rotates together with the needle extension guide cylinder to cause punch extension follower pins 42 to travel in a reverse direction upwardly along the punch extension guide slots 44. Until the follower pins 42 reach the upper ends of the slots, the detent 52 remains in a corresponding recess 55, so that no movement of the elongated needle 31 occurs. When the punch extension follower pins 42 reach the top end of the punch extension slots 44 and can no longer travel any further, further rotation of the knob 48 causes the detent 51 on the needle actuator cylinder 54 to exit the corresponding recess 55 in the connector 49, and the needle actuator cylinder 54 is once again free to rotate relative to the driving cylinder 41 and needle guide cylinder 38, causing the needle follower pins to travel up the helical needle extension slot 39 and the linear guide slot 59 to retract the elongated needle 31.

While the embodiment described above is not limited to particular materials, the cylindrical actuators and guides, as well as the punch and elongated piercing member may, by way of example and not limitation, be made of stamped and formed sheet metal, while the connector, punch holder, and needle holder may be made of a plastic material, and the outer housing and/or knob may be made of cast metal. In addition, it will be appreciated that at least some of the above-described parts may be made up of multiple or separate elements, and/or modified to accomplish the above-described functions, and also that the combined punch and piercing implement may be combined with additional elements or devices such as a cigar cutter, lighter, flashlight, key holder, and so forth to enhance the functionality of the device. These and other possible variations and modifications of the preferred embodiment described above are all intended to be included within the scope of the invention, which is defined solely by the appended claims.

What is claimed is:

1. A cigar ventilating implement, comprising:

an outer housing;

a cylindrical punch;

a first mechanism for extending the cylindrical punch by a first predetermined distance from an end of the housing;

an elongated piercing member extending through and coaxial with the cylindrical punch;

a second mechanism for extending the elongated piercing member from the housing by a second predetermined distance greater than the first predetermined distance, wherein the punch is initially extended from the housing while the elongated piercing member remains within the housing, and wherein the elongated piercing member is extended from the housing after the punch has been extended to the first predetermined distance.

2. The cigar ventilating implement as claimed in claim 1, wherein the first mechanism includes a punch driving cylinder, a punch guide cylinder, and at least one punch follower pin, wherein the at least one punch follower pin travels within and is guided by at least one punch extension slot in the punch guide cylinder to extend the punch upon rotation of the punch driving cylinder, wherein the second mechanism includes a needle actuator cylinder, a needle guide cylinder, and at least one needle follower pin fixed to the elongated piercing member, wherein the at least one needle follower pin travels within and is guided by at least one helical needle extension slot in the needle guide cylinder to extend the elongated piercing member upon relative rotation between the needle actuator cylinder and the needle guide cylinder, wherein the punch follower pin extends radially outwardly from the needle guide cylinder, wherein the needle actuator cylinder is coupled by a detent mechanism to the punch driving cylinder as the at least one punch follower pin travels within and is guided by the at least one punch extension slot to extend the punch, so that the needle actuator cylinder and the needle guide cylinder rotate simultaneously and extension of the needle is prevented, and wherein when the at least one punch follower pin reaches a lower end of the punch extension slot, further extension of the punch and movement of the needle guide cylinder is prevented, the detent mechanism decouples the needle actuator cylinder from the punch driving cylinder, and the needle actuator cylinder rotates relative to the needle guide cylinder to cause the at least one needle follower pin to travel within and be guided by the at least one helical needle extension slot to extend the needle.

3. The cigar ventilating implement as claimed in claim 2, wherein the needle guide cylinder is fixed to and rotatable with a knob, whereby initial rotation of the knob causes extension of the punch in response to movement of the at least one punch follower pin within the at least one punch extension slot, and further rotation of the knob causes extension of the elongated piercing member as the needle actuator cylinder is decoupled from the punch extension driving cylinder to enable rotation of the needle actuator cylinder relative to the needle guide cylinder and travel of the needle follower pin through the helical needle extension guide slot.

4. The cigar ventilating implement as claimed in claim 3, wherein the detent mechanism includes a detent and a plurality of recesses.

5. The cigar ventilating implement as claimed in claim 4, wherein the detent extends from a top section of the needle actuator cylinder and the plurality of recesses are provided in a connector fixed to the punch driving cylinder.

6. The cigar ventilating implement as claimed in claim 5, wherein the detent is provided on a flexible tine extending from the needle actuator cylinder.

7. The cigar ventilating implement as claimed in claim 5, wherein the connector includes a pin that extends radially outwardly through a hole in the punch driving cylinder to prevent relative rotation between the connector and the punch driving cylinder.

8. The cigar ventilating implement as claimed in claim 3, wherein the elongated piercing member is fixed to a holder, the needle actuator cylinder includes a vertically extending linear slot, the at least one needle follower pin extends radially outwardly from the holder and through the vertically extending linear slot of the needle actuator cylinder to the at least one helical needle extension guide slot of the needle guide cylinder.

9. The cigar ventilating implement as claimed in claim 8, wherein the elongated vertically extending linear slot of the needle actuator cylinder includes two horizontal end extensions that serve to prevent unintentional vertical movement of the elongated piercing member when in an extended or retracted position.

10. The cigar ventilating implement as claimed in claim 3, wherein the at least one punch extension slot includes detents located near ends of the at least one punch extension slot to prevent unintentional movement of the at least one punch extension follower when located at one of said ends.

11. The cigar ventilating implement as claimed in claim 3, wherein the at least one punch follower pin extends radially outwardly from the needle guide cylinder and through a hold in the punch driving cylinder to be received by the punch extension slot of the punch guide cylinder.

12. The cigar ventilating implement as claimed in claim 3, wherein the punch guide cylinder is inserted into and fixed to the outer housing by at least one fixing pin extending from a tine at one end of the punch guide cylinder.

13. The cigar ventilating implement as claimed in claim 3, wherein the punch is secured to the needle guide cylinder by a punch holder, the punch includes two cylindrical sections having different diameters, each cylindrical having a cutting edge such that reversal of the punch in the holder changes a cutting diameter of the punch.

14. The cigar ventilating implement as claimed in claim 3, wherein the needle guide cylinder is prevented from rotating relative to the punch driving cylinder by a connecting pin extending from the needle guide cylinder through a hole in the punch driving cylinder.

15. The cigar ventilating implement as claimed in claim 3, wherein at least the needle guide cylinder, the punch guide cylinder, and the punch driving cylinder are made of stamped and formed sheet metal.

* * * * *